US007100514B2

(12) United States Patent
LeBourgeois

(10) Patent No.: US 7,100,514 B2
(45) Date of Patent: Sep. 5, 2006

(54) PIEZOELECTRIC INCAPACITATION PROJECTILE

(75) Inventor: John LeBourgeois, El Cerrito, CA (US)

(73) Assignee: Harrington Group Ltd., (AU)

( * ) Notice: Subject to any disclaimer, the term of this patent is extended or adjusted under 35 U.S.C. 154(b) by 0 days.

(21) Appl. No.: 10/641,582

(22) Filed: Aug. 13, 2003

(65) Prior Publication Data

US 2005/0034593 A1 Feb. 17, 2005

(51) Int. Cl.
*F42B 30/02* (2006.01)

(52) U.S. Cl. ..... 102/502; 361/232; 42/1.08

(58) Field of Classification Search ..... 102/502, 102/501, 293; 361/232; 42/1.08; 463/47.3; 89/1.11, 1.1; 119/908, 174
See application file for complete search history.

(56) References Cited

U.S. PATENT DOCUMENTS 5,280,751 A * 1/1994 Muirhead et al. ..... 102/210
5,354,057 A * 10/1994 Pruitt et al. ..... 463/5
5,788,178 A * 8/1998 Barrett, Jr. ..... 244/3.11
5,936,233 A * 8/1999 Nunnally ..... 250/221
6,524,161 B1 * 2/2003 Asami ..... 446/485
6,604,946 B1 * 8/2003 Oakes ..... 434/11
6,862,994 B1 * 3/2005 Chang ..... 102/502
6,880,466 B1 * 4/2005 Carman ..... 102/502
2004/0099173 A1 * 5/2004 Rector et al. ..... 102/501
2005/0188885 A1 * 9/2005 Daigle et al. ..... 102/502

FOREIGN PATENT DOCUMENTS

GB 2 384 042 7/2003
JP 2003-42695 2/2003

* cited by examiner

*Primary Examiner*—Michael J. Carone
*Assistant Examiner*—James S. Bergin
(74) *Attorney, Agent, or Firm*—Schweitzer Cornman Gross & Bondell LLP

(57) ABSTRACT

An incapacitating piezoelectric projectile comprises a projectile body housing a piezoelectric element, at least one electrically conductive contact surface, and a means for coupling said piezoelectric element to said at least one electrically conductive contact surface. Projectile is arranged so that an impact will cause the piezoelectric element to discharge an electrical shock to the target through the at least one electrically conductive contact surface, thereby incapacitating the target. The projectile is particularly suitable for use in a method of instantly incapacitating human and non human targets.

59 Claims, 6 Drawing Sheets

PIEZOELECTRIC INCAPACITATION PROJECTILE

FIELD OF THE INVENTION

This invention relates to shocking devices and more specifically it relates to piezoelectric incapacitation projectiles for delivering voltages upon impact, and related methods of use.

BACKGROUND

Law enforcement personnel frequently encounter hostiles in the field. The traditional method of engagement is through the application or threat of application of deadly force, including the use of firearms and the execution of standard firing techniques. Traditional firearms, however, present limited options for the swift incapacitation or neutralization of a hostile. Unless the hostile is hit directly in the brain or the spinal cord, the hostile can remain effective until blood loss or cardiac failure leads to anoxia and loss of consciousness. To compensate for the absence of a one-shot incapacitating hit, most systems of combat shooting teach targeting a "center of mass" approach that relies on multiple hits to neutralize the hostile party. This often leads to medically irreparable trauma and death for the hostile party. One well publicized instance in New York saw an innocent individual shot 43 times by the police while reaching for his wallet. This tragedy illustrates a need for munitions which provide target incapacitation with a single hit.

Further illustration of shortcomings of traditional firearms as a neutralizing means can be appreciated in hostage situations or when hostiles are embedded amidst a crowd of innocent bystanders. In such cases, the danger of collateral damage and a possibility of unintended casualties limits use of traditional firearms and standard center-of-mass combat shooting. The risk of hitting unintended bystanders increases with the number of rounds fired at the intended target. In response, modern firearm ammunitions have been increasingly customized to provide projectiles with enhanced lethality due to increased wound cavity size or tissue damage, causing a more rapid loss of consciousness and motor function. This enhanced lethality would seemingly require less rounds to be fired into the target for incapacitation. However enhanced, these custom projectiles may still require a crucial amount of time for the target to succumb from resulting wounds. This lag in efficacy presents an unacceptable window for hostiles to further antagonize victims and complicate resolution of perilous encounters. There remains a need for accurate and immediate incapacitation or neutralization of suspects hidden among groups of innocent bystanders while avoiding inadvertent lethal consequences.

Moreover, traditional firearms do not address a law enforcement policy of tailoring a force response to a level of threat presented. Law enforcement personnel require a spectrum of force alternatives to dispatch a continuum of levels of threat. While use of deadly force is sometimes desirable, such action does not always represent a proportional response. Application of deadly force in instances where only neutralizing force is required exceeds the desired momentary incapacitation which would allow personnel to secure a hostile. Ideally, law enforcement field responses would be tailored to the level of threat presented. There remains a need for non-lethal devices that allow responses in proportion to the level of threat presented.

In particular, law enforcement personnel are often called upon to manage and control large groups of individuals who may be engaged in unlawful assemblies or other breaches of the peace. Various devices and methods have been conceived that provide large surface areas (bean bags) or soft materials (rubber bullets) which are designed to disperse and discourage rioting populations. The drawbacks and deficiencies of these methods have been well documented. The beanbags can be inaccurate and may cause fractures and joint damage. Rubber bullets have been shown in Israel to kill the targeted individuals if hit in the head at close range. In Oakland, Calif., the firing of wooden dowels, rubber bullets, and stinger grenades to disperse a riotous political assembly led to the wounding of dozens of protesters. See Brenda Payton, *Police Chief Word In Over His Head*, Apr. 11, 2003, Oakland Tribune. The use of brutal, non-lethal force in the Oakland engagement sparked further civic outrage, resulting in the impaneling of a special task force to investigate allegations of police impropriety. These incidents illustrate a continuing need for a rapid, reliable, safe one-shot incapacitation of targets.

One attempt to provide a force alternative to standard firearms is shown in U.S. Pat. No. 5,962,806 (hereinafter '806 patent) issued to Coakley et al. for Non-Lethal Projectile for Delivering an Electric Shock to a Living Target. Coakley describes a projectile carrying an electric circuit which uses a battery to generate an electric shock that is applied to a target through a plurality of electrodes. Coakley further discloses an attachment means intended to secure the projectile to the target upon impact. Although the teaching of Coakley may be viewed as an improvement over the prior art cited therein, including the devices commonly referred to as the "stun gun" and the "tazer", the device of the '806 patent requires complex internal circuitry and a battery power source. To house the necessary battery and circuitry, Coakley teaches a bulky projectile having substantial frontal area, which minimizes its accurate delivery. Furthermore, the battery-powered projectile necessitates a voltage indicator on the device to determine if the power source is still viable. The device also requires an adhesive or other material to insure long-term contact while delivering the electrical charge. The mass of the device requires substantial propellant for launch which is likely to produce large recoil when the device is fired, further complicating precision delivery to target. There is a need for an incapacitating method that does not rely on internal battery power for charge generation, and further that is small enough to be delivered with the accuracy of a standard firearm round.

Additionally, available systems require active engagement of mechanical elements to arm the projectile or to energize a circuit upon firing or impact, e.g., a momentum switch actuated by an arming pin. To arm such a projectile, a user must consciously decide to charge the projectile's circuitry by releasing the arming pin which otherwise electrically disconnects a battery power source from the remainder of an electric circuit. Once the projectile is so armed, a momentum switch is free to toggle upon impact to activate a charging circuit. Having an arming sequence in addition to a firing maneuver unnecessarily complicates rapid target incapacitation. Requiring an operator to first arm an incapacitating firing projectile introduces human processing error to a tension-filled execution sequence where split seconds may prove crucial. Thus there remains a need for a simple method of incapacitating a target that eliminates or minimizes reliance on moving parts, and that is not predicated on fallible human action to facilitate accurate effective delivery.

Piezoelectric (hereinafter "PZ") materials provide an alternative to batteries as reliable, portable sources of voltage. Piezoelectricity is a property of certain classes of crystalline materials including natural crystals of Quartz, Rochelle Salt and Tourmaline plus manufactured ceramics such as Barium Titanate and Lead Zirconate Titanates. PZ materials convert mechanical stresses to electrical voltages and electrical voltages to mechanical stresses. Although PZ materials have been known for many years, advances in the state of the art have led to a progression of multiple materials, both natural and manmade, that exhibit increasing PZ potentials.

PZ materials are employed in such common devices as spark igniters for disposable lighters, to Stove Top igniters, Blasting Cap detonators and other devices which require short duration, high intensity sparks. PZ materials also convert electrical energy to sound and mechanical values, as found in stereo and sonar systems. Resulting electrical voltages from activated PZ materials range from 25,000 volts in a sparking lighter, to over 250,000 volts in a destructive crush mode system. In contrast, battery-operated commercial stun guns designed to provide rapid incapacitation of targets typically generate voltages in the range of 25,000 to 75,000 volts. PZ materials exist as a substitute for battery-derived electrical charge production. In addition, PZ are capable of being molded into a variety of desired shapes. Thus, PZ materials can be characterized as providing a broad effective range of voltages to be tailored toward specific lethal or non-lethal objectives.

SUMMARY

The present invention addresses the needs above as well as other needs by providing a piezoelectric incapacitation projectile for instantaneous incapacitation of a target by generating and dispensing an electric shock upon target impact. The present invention further provides a method for delivering an incapacitating charge to a target, the charge resulting from firing a piezoelectric projectile or on projectile impact. It is a purpose of this invention to provide non-lethal incapacitation of a target.

In one embodiment, the present invention can be characterized as a penetrating projectile such as a bullet, shell or fragment, or other configuration, for delivering an incapacitating electrical shock to a target. The projectile comprises a first electrode and a second electrode attached to a body, wherein both electrodes are electrically connected to a piezoelectric (PZ) element with the body. The first electrode is preferable positioned on a front, or leading edge of the projectile. The projectile is configured such that any impact, thermal energy, mechanical stress, deformation or destruction of the PZ material by mechanical force, such as an impact force, releases an electrical discharge in proportion to the mechanical force. The projectile then directs the electrical discharge into the target material, resulting in incapacitation, damage, stun or destruction of the target.

In a variation of the above embodiment, the present invention can be adapted into a non-penetrating projectile, as for example a sphere or slug or other shape for use in riot control. The projectile may have a body containing a striker assembly which acts as a safety by impacting the PZ body only upon impact. The projectile may further incorporate a cap, which can house a material such as an electrolyte, for enhanced conductive interface.

In an alternative embodiment, the above-described projectile may also include pyrotechnic charges which that detonate upon projectile firing or upon target impact. Such charge detonation provides an additional pyroelectric effect on the PZ material, augmenting the electrical discharge to the target.

In another variation, a projectile according to the present invention is shaped into a rubber ball with a conductive contact surface (e.g. a front, or leading surface) and a plurality of wires trailing behind the ball. A single ball may be deployed to disable a single target or multiple targets. Additionally, a plurality of balls may be packed together and launched out of a common casing to address a single threat or multiple threats simultaneously.

In each embodiment of the present invention, the PZ material may be orientated in such a way as to enable the acceleration forces, thermal effects from the propellant forces associated with impact on the targeted personnel to be converted to electrical energy which is then transferred to the targeted personnel by one or more electrodes. One skilled in the art can readily extend the number, shape and type of electrically conducting structures that would transfer the electrical charge from the PZ material to the targeted personnel. Furthermore, the size, shape, and orientation of the PZ material may be optimally configured to enhance the desired incapacitation or effect. Nor is there any particular limitation on the stresses that charge the piezoelectric material, such as acceleration, hoop stresses from rotation, or pyroelectric effects from thermal energy, which would provide the energy for terminal effects.

In another embodiment which may be suitable for targeting electronic materials, the PZ material can be utilized so that the mechanical energy of target impact at high velocities causes the PZ material to destructively compress, thus generating a high transient voltage spike, or Electro-Static Discharge (ESD). This ESD can be directed into the target material as a direct electrical charge, or when directed through the appropriate electronic/electrical apparatus, as an Electro-Magnetic Pulse (EMP). The directed ESD/EMP is capable of causing failure in computer systems and electrical component, as the small thin film gates in integrated circuits, micro traces on printed circuit boards, or other electro/optical components are vaporized by the pulse energies. Magnetic media may also be erased or destroyed by the ESD/EMP. The inherent advantage of this embodiment is that ESD/EMP effects may propagate well beyond the immediate area of contact, including penetration through normal armor that would be proof against explosive projectiles, which is commonly used to shield battlefield electronic devices.

BRIEF DESCRIPTION OF THE DRAWINGS

Several embodiments of the present invention will now be more particularly described with reference to the accompanying drawings wherein.

DETAILED DESCRIPTION OF THE DRAWINGS

The following description is an example of a best mode of the invention, including use of the invention as a firearm projectile. This description is not meant to limit or constrain the scope of the invention, but to describe the general principles of the invention. While certain novel features of this invention have been shown and described and are referred to in the accompanying claims, it will be understood that various omissions, substitutions, and changes in the forms and details of the device illustrated and in its operation can be made by those skilled in the art without departing from the spirit of the invention.

Figure 1:
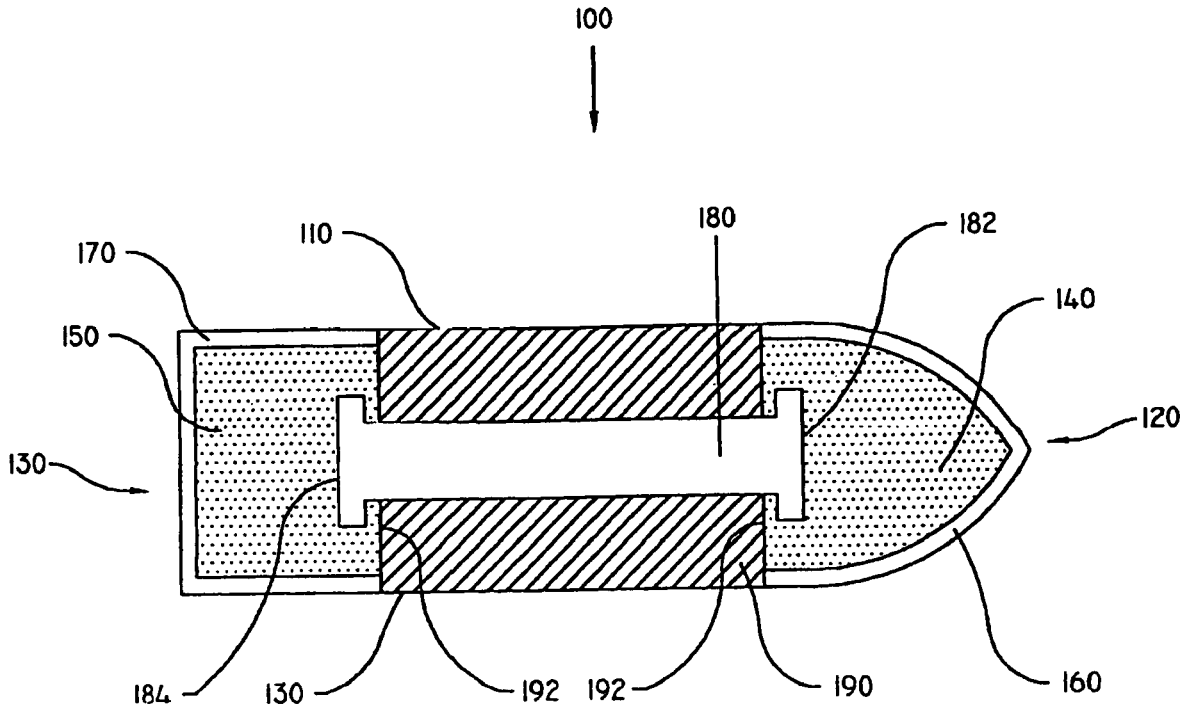
FIG. 1 is a partial side cross-sectional view of an incapacitating piezoelectric projectile in accordance with one embodiment of the present invention.

Referring to FIG. 1, a projectile 100 comprises a body 110 disposed between a front end 120 and a base end 130. Front end 120 houses a front electrode 160 constructed of an ogive conducting material, such as a copper. Alternatively, any electrically conducting material may be used. Front electrode 160 serves as an initial contact with a target (not pictured) and the shape of front electrode 160 can be machined to enhance the desired level of incapacitation (e.g. a penetrating point). Underlying front electrode 160 is a front mass 140 of any suitable material including standard lead-antimony alloy. Base end 130 houses a base electrode 170 formed of a conducting base material, as for example copper. Underlying base electrode 170 is a rear mass 150 formed of a suitable material, such as standard lead-antimony alloy.

Body 110 comprises a piezoelectric (PZ) material 190 and is in operative electrical contact with front electrode 160 and base electrode 170. A cushioning conductive material 192 may be placed between the PZ material 190 and the electrodes 160 and 170. The PZ material 190 may be chosen from any of a class of naturally occurring or ceramic composite PZ materials provided the material is capable of converting mechanical energy to electrical energy. The PZ material 190 of body 110 may be disposed along any axis or orientation to provide customization of discharge and mechanical properties of the charge-generating material. To further configure the PZ material 190 with a set of properties optimized for an intended use, the PZ material 190 may take a plurality of shapes comprising cones, rods, wafers, cylinders, laminates, trapezoids, rectangles or cubes. In the embodiment of the invention shown in FIG. 1, a cylindrical PZ material is shown as an illustration of one possible form of said PZ material 190.

An additional guide rod 180 may be placed through the middle of body 110. Guide rod 180 may be formed of a non-conductive material or may utilize a conductive material, the material to be chosen to optimize the desired projectile incapacitation. The guide rod 180 has a front flange 182 embedded in front mass 140 and a rear flange 184 embedded in rear mass 150, the guide rod 180 serving to stabilize and support front electrode 160 and rear electrode 170 about the body 110.

Projectile 100 may be machined to the appropriate weight and dimensions to conform with a standard firearm projectile, such as a 0.40 caliber Smith & Wesson round. The projectile 100 has a total mass of between 135 grains to 185 grains, with an optimal mass of 155 grains. Mass of projectile 100 is customizable for mission-specific applications. The projectile 100 may be breech-loaded as a single projectile, and may also be loaded into a magazine or case, as is customary in reloading. Preferably, the projectile 100 may be matched to a cartridge casing with sufficient propellant to provide an effective muzzle velocity of between a minimum 990 fps and maximum velocity of 1250 fps, with a preferred velocity of 1140 fps.

A mechanism for generating an incapacitating charge to be delivered by projectile 100 will now be described. Upon discharge from a firearm (not shown) the projectile 100 will travel a trajectory to target. Upon impact, the projectile 100 will begin to penetrate the target and will experience negative acceleration as it encounters the target material. This acceleration will cause the front mass 140 and front electrode 160 to compress the front of the PZ material 190 as the inertia of the PZ material 190 causes it to move into front mass 140. Simultaneously, rear mass 150 and base electrode 170 provide additional mass to compress the rear of the PZ material 190. As the projectile 100 penetrates the target and enters the target interior, the combined forces of negative acceleration and inertial compression will initiate an electrical discharge throughout the PZ material 190. An additional component of lateral stress will also operate on the material 190 as the projectile 100 penetrates the target. Additionally, propellant gases discharged upon firing from the cartridge housing (not shown) may also be used to charge the PZ material 190 through thermal effects. The sum of said forces and effects will combine to cause the catastrophic crush and destruction of the PZ material 190, said PZ material 190 consequently producing an electrical charge. The PZ material 190 is capable of transferring the combined mechanical forces to the electrical discharge through front electrode 160 and base electrode 170 to the target medium, with a discharge of at least 25,000 volts. An electrical shock of such magnitude to a human target, in particular to the nervous system of a human target, is sufficient to cause instantaneous incapacitation of a human regardless of the site of penetration. Thus, in one embodiment, the present invention may be characterized as a "flying stun gun" for rapid target incapacitation.

Although the embodiment shown in FIG. 1 is capable of penetrating a target due to its size and effective velocity, an incapacitating charge may be delivered to target by projectile 100 even if base electrode 170 does not embed in target material. As front end 120 of projectile 100 contacts a target surface, PZ material 190 is compressed resulting in electrical discharge. Upon impact, both front electrode 160 and base electrode 170 are placed proximate enough to target to permit formation of an arc involving electrodes 160 and 170 and target, thereby completing an electrical circuit between the electrodes 160 and 170 of projectile 100 that includes the target. An incapacitating charge may thus be transferred to target even though projectile 100 may not penetrate target entirely.

As can be appreciated by those skilled in the art, the design of the electrodes 160 and 170, the PZ material 190, and ballistic properties of the projectile 100 can all be adjusted to tailor the terminal effects of the projectile 100 and it's functioning to particular user requirements.

Figure 2:
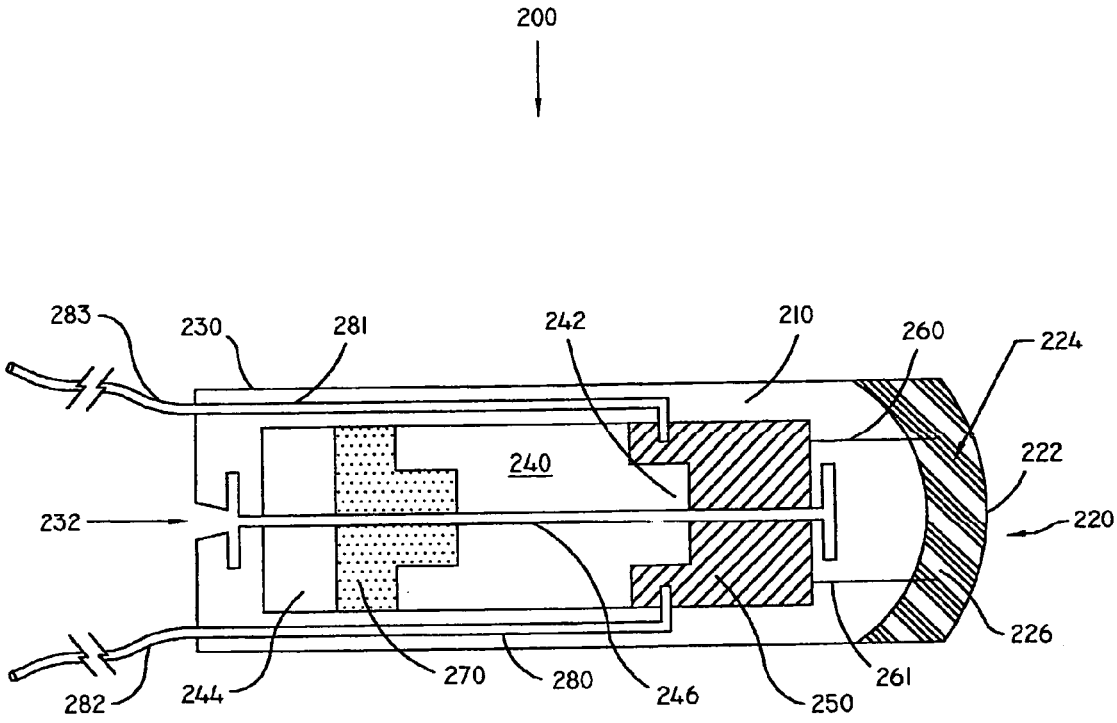
FIG. 2 is a partial side cross-sectional view of another embodiment of an incapacitating piezoelectric projectile according to the present invention, wherein a striker is arranged to deliver a force upon impact to a piezoelectric material located in a body portion of the projectile.

Referring next to FIG. 2, an embodiment of the present invention particularly suited for non-penetrating use is described. A projectile 200 comprises a body 210, a front end 220, and a base end 230, the body 210 disposed between the front end 220 and the base end 230 and having a longitudinally extending lumen 240 containing a PZ material 250 positioned in a fore section 242 of said lumen 240.

Body 210 is preferably cylindrical, although body 210 may take any desired shape, including cubes, columns, frusta, pyramids, and cylinders.

The PZ material 250 may take any appropriate form including individual or a series of wafers, cylinders, or cubes, or a combination of said forms. The PZ material contacts a number of front electrodes such as 260 and 261 and a number of rear electrodes such as 280 and 281. The projectile 200 may be constructed of an appropriate size casing, including 37 mm or 40 mm.

Front electrodes 260 and 261 each have a terminus on a projectile face 222 on front end 220. The projectile face 222 may further incorporate a destructible compartment 224 containing a conductive material 226 to be dispersed upon projectile impact. Any ionic polymer gel or an electrolyte marking dye may be suited for use as conductive material 226. The rear electrodes 280 and 281 emanate from the charge-generating PZ material 250 and thread through the body 210 of the projectile 200, extending through the base end 230, and terminate in at least one trailing element which roughly trace the trajectory of the projectile flight. The particular embodiment of the invention illustrated in FIG. 2 incorporates two trailing elements 282 and 283. The trailing elements 282 and 283 may be composed of a conductive material, such as wire, and can have a suitable range of lengths, as for example between 0.5 inches and 24 inches or between 1 inch and 15 inches, with a preferred length of 11 inches.

A guide tube 246 extends from an aperture or vent 232 on the base end 230 of the projectile 200 to the PZ material 250, such that the vent conducts thermal energy produced from the propellant gases released upon firing through the guide tube to the PZ material 250. A striker 270 in the lumen 240 has the guide tube 246 placed through its center (not shown) and is in line with the PZ material 250. The striker 270 is initially stationed toward an aft section 244 of the lumen 240, and is mobile along the length of the guide tube 246 according to the acceleration of the projectile 200. Prior to discharge, striker 270 may be restrained in aft section 244 by static friction, as the exterior surface of striker 270 lies flush against the interior surface of lumen 240. The striker 270 comprises any appropriate high density material and may be specifically shaped to optimize striker-PZ material engagement.

A mechanism for generating an incapacitating charge to be delivered by projectile 200 will now be described. Upon firing, the projectile 200 assumes a trajectory to target. Upon target impact, the compartment 224 on the projectile face 222 ruptures releasing the conductive material 226 onto the target and provides an enhanced conductive medium, as well as cushioning the impact. Additionally upon impact, the inertia of the striker 270 slides the high-density mass forward along guide tube 246 where striker 270 impacts the PZ material 250. The mechanical energy of the striker impact, along with any setback or pyroelectric charges from said projectile firing, produces an electric charge in the PZ material 250. The PZ material 250 conducts charge to the target through the front electrodes 260 and 261. The charge is also dispersed through the trailing elements 282 and 283, which provide stabilizing aerodynamic drag to the projectile 200 while in free flight. Additionally, the trailing elements 282 and 283 provide a contact surface capable of delivering the incapacitating charge to the target, substantially increasing the effective contact area from the area of the projectile face 222 alone to the aggregate of the projectile face 222 and a circle whose radius is equal to the length of the trailing elements 282 and 283.

Figure 3:
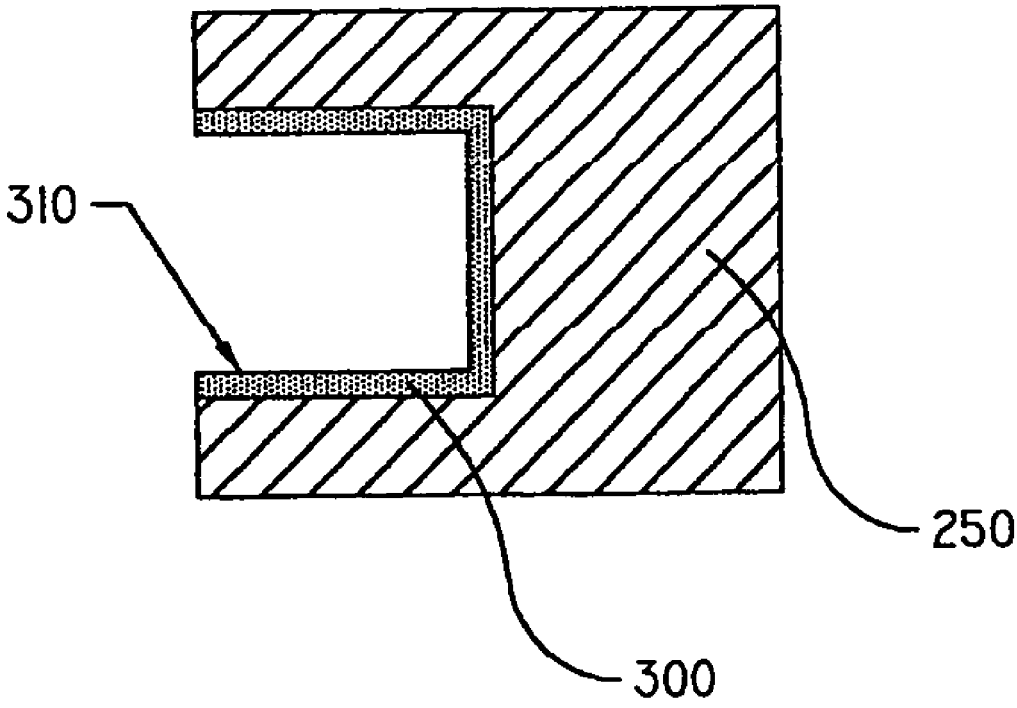
FIG. 3 is an enlarged cross-sectional view of a further embodiment of the striker of FIG. 2.

Referring next to FIG. 3, a further embodiment of the PZ material 250 disposed in the forward lumen 240 of projectile 200 is shown. A pyrotechnic charge 300 is placed along a luminal surface 310 of the PZ material 250. The charge 300 may be ignited upon the impact of the striker 270 to induce additional thermal to pyroelectric charging of the PZ material 250. Ignition of charge 300 may result from frictional heat produced by striker-lumen contact, as the striker 270 slides flush along luminal surface 310 of PZ material 250.

Figure 4:
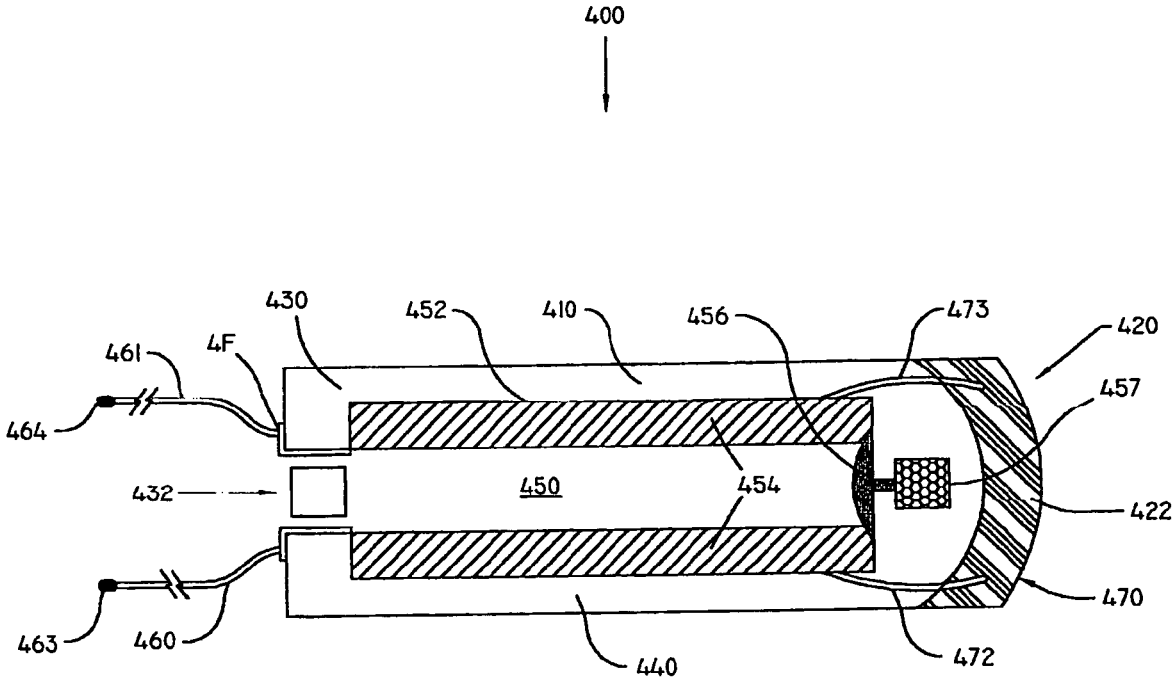
FIG. 4 is a side cross-sectional view of a projectile according to the present invention having one or more trailing elements.

Referring next to FIG. 4, another embodiment in accordance with the present invention is described wherein a projectile 400 comprises a shell 410, a front end 420 having a target contact surface 422, a base end 430, and a casing 440 having a circumferential cavity or lumen 450 extending along a longitudinal axis of said casing 440. The shell 410 may be constructed of any suitable material, such as rubber, and is adaptable to fit inside a standard firearm round, including a 12-gauge round commonly used in riot control. The lumen 450 comprises an interior surface 452 and a lining of PZ material 454 along the interior surface 452 of an appropriate thickness. The base end 430 may feature at least one vent 432 which provides an opening into the lumen 450 through the base end 430. At least one trailing element, as for example 460 and 461, originate from the PZ material 454, and extend from the base end 430 of the projectile 400. The trailing elements 460 and 461 may be a conductive material such as copper wire. The casing 440 may be either conductive or non-conductive, both embodiments to be described below.

In a projectile 400 having a casing 440 which is non-conductive, a front electrode 470 is placed on the target contact surface 422 of the projectile 400. Front electrode 470 comprises any suitable conducting material, as for example copper or aluminum, and is connected to PZ material 454 through the casing 440 by at least one lead, as for example 472 and 473. Alternatively, a projectile 400 having a casing 440 with electrically conducting properties obviates the need for an additional front electrode 470, the casing 440 in continuous operative electrical contact with the PZ material 454 and capable of distributing a charge throughout the surface of the casing 440.

A mechanism for generating an incapacitating charge to be delivered by projectile 400 will now be described. Projectile 400 will travel in free flight upon discharge from a firearm (not shown). Upon impact, the PZ material 454 will experience a series of forces comprising impact and hoop forces, in addition to its own inertial force, causing it to discharge an electrical shock. An optional and additional method of generating charge in the PZ material comprises igniting a pyrotechnic material 456 which is ignited by propellant gases upon projectile firing or by an impact fuse 457 to provide thermal charging via pyroelectric effects upon projectile impact. Impact fuse 457 may be formed of any stable material which is easily ignited by impact force, such as standard $KNO_3$ gunpowder. Propellant gases discharged from the cartridge housing (not shown) may also be used to directly charge the PZ material 454 through thermal effects. The incapacitating charge thus produced is transferred to the target through the target contact surface 422 wherein an electrically conductive material, either the front electrode 470 or the conductive casing 440, conducts an incapacitating charge to the target. In addition the incapacitating charge may be discharged to the target through the trailing elements 460 and 461, said elements extending the discharge area of the charge across a wider area of the target than the contact surface 422 placed on the front end 420 of the projectile 400. The trailing elements 460 and 461 provide the additional benefit of providing stabilizing drag to correctly orient the projectile with the front end 420 impacting the target. The trailing elements 460 and 461 may further include weighted conductive tips 463 and 464.

Figure 5:
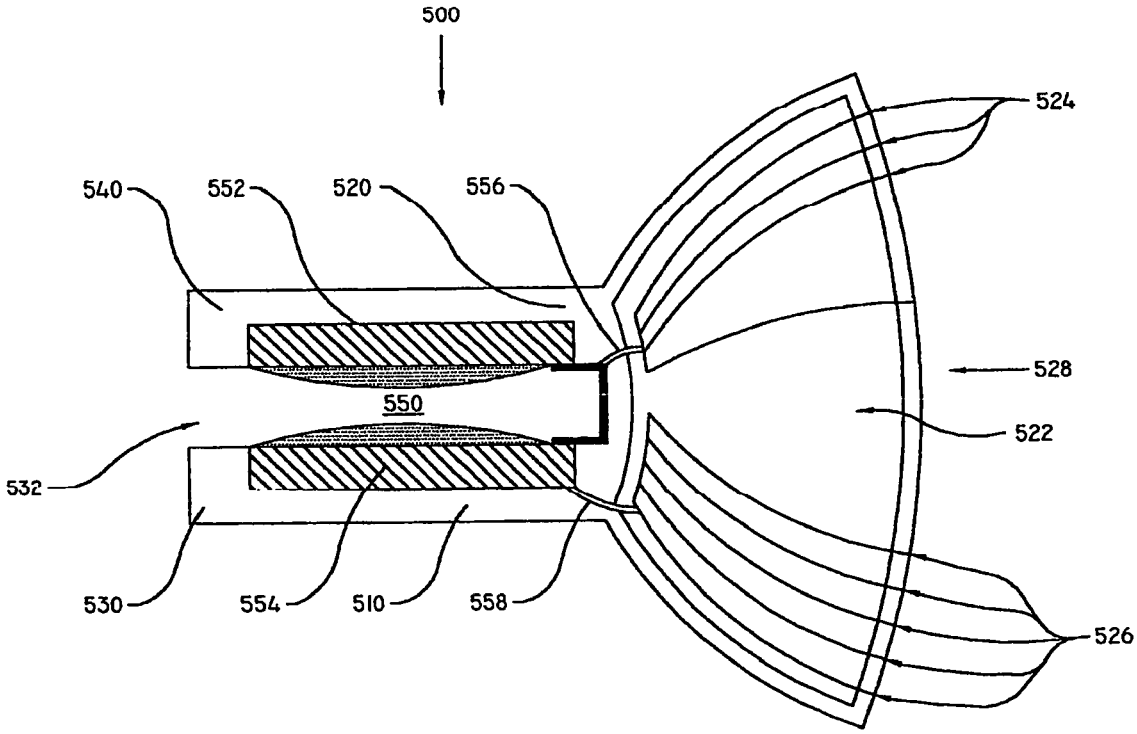
FIG. 5 is a side cross-sectional view of an alternative embodiment of the present invention having an array of deployed electrodes.

Referring next to FIG. 5, another embodiment of a nonpenetrating incapacitating projectile suitable for use against a single target or multiple targets is described, in accordance with the present invention. A projectile 500 comprises a body 510, a front end 520, also termed herein a leading end, having a front compartment 522 comprising a cylindrical plurality of folded electrodes, as for example 524 and 526, a base end 530, and a casing 540 having a circumferential cavity or lumen 550 extending along a longitudinal axis of the casing 540.

The body 510 may be made from any suitable material and is adaptable to fit inside a standard firearm casing, including 37 mm or 40 mm firearm casings. The lumen 550 comprises an interior surface 552 and a lining of PZ material 554 along the interior surface 552 of an appropriate thickness. The base end 530 may feature at least one vent 532 which provides an opening into the lumen 550 through the base end 530. The projectile 500 may be characterized by at least one conductive trailing element (not shown) originating from the PZ material 554, and extending from the base end 530 of the projectile 500.

A mechanism for generating an incapacitating charge to be delivered by projectile 500 will now be described. Upon projectile launch or firing, the folded electrodes 524 and 526 represent the frontal area of projectile 500 and are subjected to turbulent shear forces from aerodynamic drag. Said shear forces cause electrodes 524 and 526 to unfold to present contact area 528 of between 1.5 to 3 times the diameter of the projectile diameter, preferably twice the projectile diameter. The arrayed electrodes 524 and 526 are connected to a positive pole 556 and a negative pole 558, respectively, of the PZ material 554. A vent 532 may be present to allow propellant gases to charge the PZ material 554 through thermal effects and ignite an optional pyrotechnic charge 554 placed in the lumen 550 for additional thermal effects. As in the embodiments described in FIGS. 1–4 above, upon impact with the target, PZ material is perturbed through a combination of forces including projectile setback, pyroelectric effects, and mechanical impact, producing a PZ charge to be discharged through the arrayed electrodes 524 and 526 on the front of the projectile 500. The electrodes may be of any such shape, geometry, spacing and length as required to optimize the delivery of energy to the target.

Figure 6:
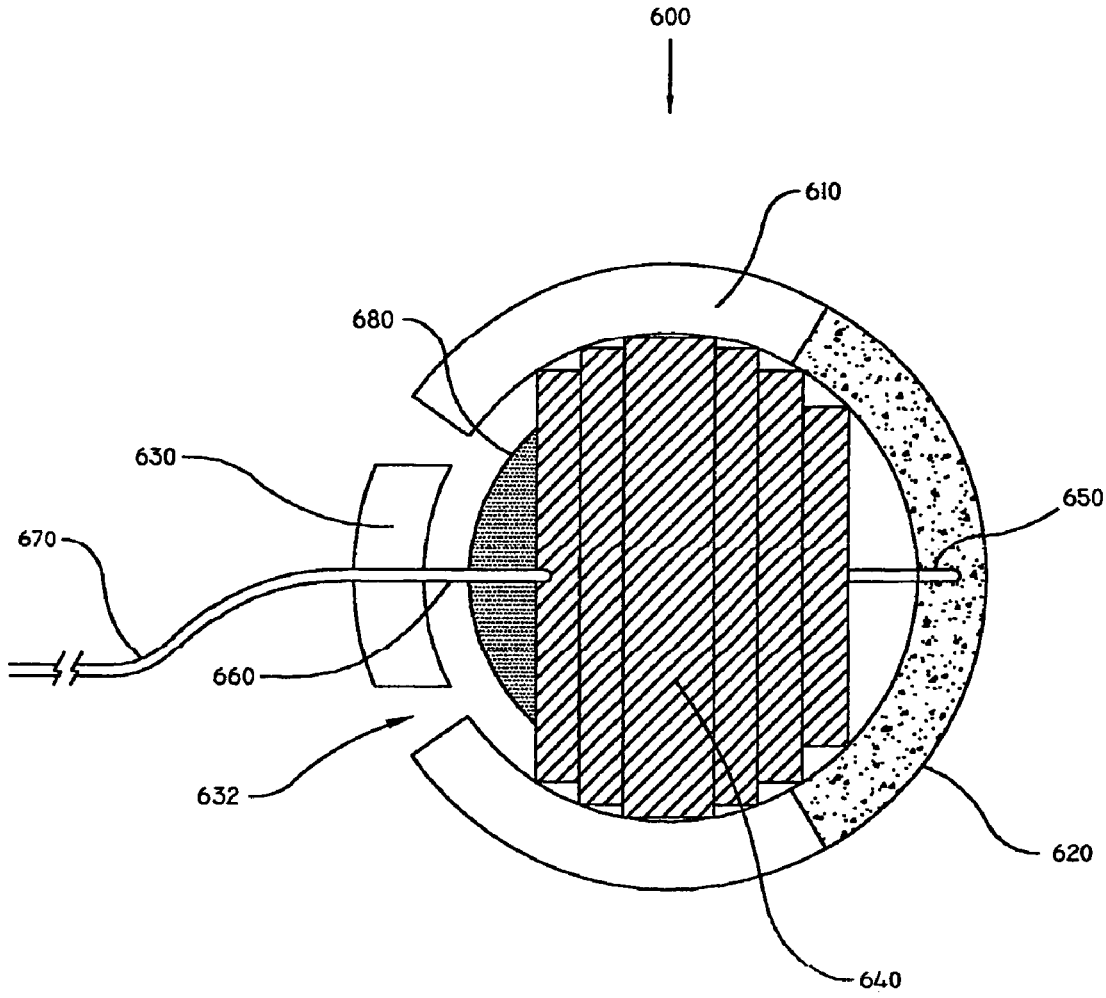
FIG. 6 is a side cross-sectional view of another embodiment of the present invention.

Referring next to FIG. 6, a further embodiment in accordance with the present invention is described. A piezoelectric incapacitation projectile 600 comprises a shell 610 having a front contact area 620 and a base area 630. The shell 610 may be made of a conducting or non-conducting material, including but not limited to rubber or other polymer, and may have a vent 632 in the base area, allowing exposure to the PZ core 640 through the shell 610. A front electrode 650 connects the PZ core 640 to the front contact area 620 which may be formed of a suitable material such as conducting rubber or copper foil. A real electode 660 is connected to one of more tailing elements, as for example 670, of between 0.5 inches to 15 inches in length, with a preferred length of 4 inches. It will be noted that multiple projectiles 600 may be amassed in a single casing (not shown), for example a 66 mm vehicle-launched crowd control round, to address multiple targets with one firing sequence. The PZ core 640 may include a concentric stack of piezoelectric materials of increasing and decreasing diameter layered in series.

A mechanism for generating an incapacitating charge to be delivered by projectile 600 will now be described. As in the above embodiments, projectile 600 or plurality of projectiles will travel in free flight upon discharge from a launch device (not shown). The firing of the projectile may ignite an optional propellant or dispersing pyrotechnic charge 680 which may be utilized to enhance the electrical charge of the PZ core 640 through pyroelectric effects. Upon impact the mechanical forces and/or the pyroelectric charge 680 release energies through the conducting front electrode 650 and the trailing element 670. Similar to the embodiments presented above, the trailing element 670 extends the discharge area of the charge across a wider area of the target than simply the front contact area 620 alone. An additional advantage is that the trailing element 670 provides aerodynamic drag which correctly orients the projectile 600 so as to present the front electrode surface 660 to the target. Any trailing element such as 670 may conduct throughout its length or just from the terminal tips of the conductive material.

It is notable that those skilled in the art will recognize that various rubber or rubber like materials may be utilized in the design, and various techniques of the art may be used to optimize the terminal characteristics, including but not limited to, the wave form characteristics of the discharge and the intensity of the electrical discharge. Similarly, while shell 610 is shown as substantially spherical, one skilled in the art will appreciate that other shapes may be employed, e.g., cylindrical, elliptical, and the like.

In each of the above-described embodiments, a variety of methods may be used to create the stresses in the PZ material that will result in the piezoelectric effect and discharge of the generated electric charge into the target. These methods include acceleration, de-acceleration, pyroelectric/thermal effects, hoop stresses and other such methods that result in an electrical charge being generated by the PZ material. This list is not exhaustive and should not be construed as limiting, but merely illustrative of the various avenues by which a goal of electric charge generation in a PZ material may be accomplished.

The present invention is useful and may be applicable in a broad range of circumstances where high energy discharge is delivered to a target with the purpose of neutralization or incapacitation. The foregoing description is neither exhaustive nor intended to limit the invention to the precise forms disclosed. The present invention includes modifications and their equivalents which are apparent to a practitioner of ordinary skill. For example, whereas particular geometries or materials have been described, it will be appreciated that in many instances these geometries and/or materials may be modified, re-ordered or adapted, without departing from the scope of the invention. The embodiments herein were chosen and described in order to best explain the principles of the invention and its practical application, thereby enabling others skilled in the art to understand the invention for various embodiments and with various modifications as are suited to the particular usage contemplated. It is intended that the scope of the invention be defined by the following claims and their equivalents.

What is claimed is:

1. A projectile comprising:

a body having at least one electrically conducting surface; and at least one piezoelectric element disposed in said body and in electrical communication with the electrically conducting surface of said body, said piezoelectric element capable of generating an electrical potential, wherein said piezoelectric element discharges the electrical potential to a target through the electrically conducting surface upon impact with the target.

2. The projectile of claim 1 wherein said body has a penetrating form adapted for penetrating a target.

3. The projectile of claim 2 wherein the penetrating form is any of a bullet, a shell, or a fragment.

4. The projectile of claim 1 wherein said piezoelectric element is charged by at least one force comprising hoop stress, pyroelectric effects, or inertial force, including inertial impact force or inertial projectile setback force.

5. The projectile of claim 1 wherein said body has a non-penetrating form adapted to strike a target without penetrating the target.

6. The projectile of claim 5 wherein the non-penetrating form-comprises any of a sphere or a slug.

7. The projectile in claim 6 wherein the form is a sphere, said sphere having a core comprising a concentric stack of piezoelectric material of increasing and decreasing diameter layered in series, a deposit of pyrotechnic material in a base end, and at least one vent on said base end exposing said pyrotechnic material to propellant gases to actuate pyroelectric charging of said piezoelectric core.

8. The projectile of claim 5 wherein said at least one electrically conducting surface on the nonpenetrating form includes a destructible cap containing an electrolytic contact agent, whereupon impact said cap bursts, and subsequent to the burst, releases said electrolytic contact agent onto said target.

9. The projectile of claim 1 wherein said body is adapted to a standard firearm casing.

10. The projectile of claim 9 wherein said standard firearm casing comprises any of a 12-gauge, a 37 mm, a 40 mm, or a 66 mm casing.

11. The projectile in claim 1 wherein said at least one electrically conducting surface is an electrode array folded to fit into said body, whereupon firing said electrode array unfolds to present an enlarged electrically conducting contact surface.

12. The projectile in claim 1 wherein said at least one electrically conducting surface is a trailing element having a length that extends from a base end.

13. The projectile in claim 12 wherein said trailing element is a wire.

14. The projectile in claim 12 wherein said length is from 0.5 inch to 24 inches in length.

15. The projectile of claim 1, further comprising a pyrotechnic charge within said body.

16. The projectile of claim 15, further comprising an impact fuse operable to detonate said pyrotechnic charge upon impact of said projectile with the target.

17. The projectile of claim 15, further comprising a vent to permit propellant gases to actuate said pyrotechnic charge.

18. The projectile of claim 15, wherein a pyroelectric effect of said pyrotechnic charge produces an electrical potential in said piezoelectric element.

19. The projectile of claim 1, further comprising a lumen within said body and a vent in communication with said lumen.

20. The projectile of claim 1, further comprising a lumen within said body and said piezoelectric element comprises a lining of said lumen.

21. The projectile of claim 20, further comprising a vent in communication with said lumen.

22. The projectile of claim 1, comprising:

said projectile having a forward end and a trailing end;

a lumen within said body;

a vent located on said trailing end of said projectile, said vent being in communication with said lumen.

23. A projectile comprising:

a body adapted to impact a target;

at least one piezoelectric element disposed in said body and having a first end and a second end, said piezoelectric element capable of generating an electrical potential between the first end and the second end;

a first electrode in electrical communication with the first end of said piezoelectric element; and a second electrode in electrical communication with the second end of said piezoelectric element, wherein upon impact with the target said piezoelectric element discharges the electrical potential through the first and second electrodes to the target.

24. A projectile comprising:

a body having at least one electrically conducting surface; and at least one piezoelectric element disposed in said body and in electrical communication with the electrically conducting surface of said body, said piezo electric element capable of generating an electrical potential, a pyrotechnic charge within said body, and and vent to permit propellant gases to actuate said pyrotechnic charge, wherein said piezoelectric element discharges the electrical potential to a target through the electrically conducting surface upon impact with the target.

25. A projectile comprising:

a body having at least one electrically conducting surface; and at least one piezoelectric element disposed in said body and in electrical communication with the electrically conducting surface of said body, said piezoelectric element capable of generating an electrical potential, and a lumen within said body and said piezoelectric element comprises a lining of said lumen, wherein said piezoelectric element discharges the electrical potential to a target through the electrically conducting surface upon impact with the target.

26. The projectile of claim 25, further comprising a vent in communication with said lumen.

27. A projectile comprising:

a body having at least one electrically conducting surface; and at least one piezoelectric element disposed in said body and in electrical communication with the electrically conducting surface of said body, said piezoelectric element capable of generating an electrical potential, and a pyrotechnic charge within said body, wherein a pyroelectric effect of said pyrotechnic charge produces an electrical potential in said piezoelectric element, and wherein said piezoelectric element discharges the electrical potential to a target through the electrically conducting surface upon impact with the target.

28. The projectile of claim 27, further comprising an impact fuse operable to detonate said pyrotechnic charge upon impact of said projectile with the target.

29. A projectile comprising:

a body having at least one electrically conducting surface; and at least one piezoelectric element disposed in said body and in electrical communication with the electrically conducting surface of said body, said piezoelectric element capable of generating an electrical potential, and a pyrotechnic charge within said body, wherein said pyrotechnic charge produces an electrical potential in said piezoelectric element, and wherein said piezoelectric element discharges the electrical potential to a target through the electrically conducting surface upon impact with the target.

30. The projectile of claim 29, further comprising an impact fuse operable to detonate said pyrotechnic charge upon impact of said projectile with the target.

31. A projectile comprising:

a body having at least one electrically conducting surface;

at least one piezoelectric element disposed in said body and in electrical communication with the electrically conducting surface of said body;

means to produce an electrical potential in said piezoelectric element of at least about 25,000 Volts; and said means to produce said electrical potential of 25,000 volts not including a moving striker element;

wherein said piezoelectric element discharges the electrical potential to a target through the electrically conducting surface upon impact with the target.

32. The projectile of claim 31, wherein said body has a penetrating form adapted for penetrating a target.

33. The projectile of claim 32, wherein the penetrating form is any of a bullet, a shell, or a fragment.

34. The projectile of claim 31, wherein said piezoelectric element is charged by at least one force comprising hoop stress, pyroelectric effects, or inertial force, including inertial impact force or inertial projectile setback force.

35. The projectile of claim 31, wherein said body has a non-penetrating form adapted to strike a target without penetrating the target.

36. The projectile of claim 35, wherein the non-penetrating form-comprises any of a sphere or a slug.

37. The projectile in claim 36, wherein the form is a sphere, said sphere having a core comprising a concentric stack of piezoelectric material of increasing and decreasing diameter layered in series, a deposit of pyrotechnic material in a base end, and at least one vent on said base end exposing said pyrotechnic material to propellant gases to actuate pyroelectric charging of said piezoelectric core.

38. The projectile of claim 35, wherein said at least one electrically conducting surface on the nonpenetrating form includes a destructible cap containing an electrolytic contact agent, whereupon impact said cap bursts, and subsequent to the burst, releases said electrolytic contact agent onto said target.

39. The projectile of claim 31, wherein said body is adapted to a standard firearm casing.

40. The projectile of claim 39, wherein said standard firearm casing comprises any of a 12-gauge, a 37 mm, a 40 mm, or a 66 mm casing.

41. The projectile in claim 31, wherein said at least one electrically conducting surface is an electrode array folded to fit into said body, whereupon firing said electrode array unfolds to present an enlarged electrically conducting contact surface.

42. The projectile in claim 31, wherein said at least one electrically conducting surface is a trailing element having a length that extends from a base end.

43. The projectile in claim 42, wherein said trailing element is a wire.

44. The projectile in claim 42, wherein said length is from 0.5 inch to 24 inches in length.

45. The projectile of claim 31, further comprising a pyrotechnic charge within said body.

46. The projectile of claim 45, further comprising an impact fuse operable to detonate said pyrotechnic charge upon impact of said projectile with the target.

47. The projectile of claim 45, further comprising a vent to permit propellant gases to actuate said pyrotechnic charge.

48. The projectile of claim 45, wherein a pyroelectric effect of said pyrotechnic charge produces an electrical potential in said piezoelectric element.

49. The projectile of claim 48, further comprising an impact fuse operable to detonate said pyrotechnic charge upon impact of said projectile with the target.

50. The projectile of claim 31, further comprising a lumen within said body and a vent in communication with said lumen.

51. The projectile of claim 31, further comprising a lumen within said body and said piezoelectric element comprises a lining of said lumen.

52. The projectile of claim 51, further comprising a vent in communication with said lumen.

53. The projectile of claim 31, comprising:

said projectile having a forward end and a trailing end;

a lumen within said body;

a vent located on said trailing end of said projectile, said vent being in communication with said lumen.

54. A projectile comprising:

a body having at least one electrically conducting surface; and at least one piezoelectric element disposed in said body and in electrical communication with the electrically conducting surface of said body, said piezoelectric element capable of generating an electrical potential, and a pyrotechnic charge within said body, wherein said pyrotechnic charge produces an electrical potential in said piezoelectric element, and wherein said piezoelectric element discharges the electrical potential to a target through the electrically conducting surface upon impact with the target.

55. The projectile of claim 54, further comprising an impact fuse operable to detonate said pyrotechnic charge upon impact of said projectile with the target.

56. A projectile comprising:

a body adapted to impact a target;

at least one piezoelectric element disposed in said body and having a first end and a second end, said piezoelectric element capable of generating an electrical potential between the first end and the second end;

a first electrode in electrical communication with the first end of said piezoelectric element;

a second electrode in electrical communication with the second end of said piezoelectric element;

means to produce an electrical potential in said piezoelectric element of at least an amount effective to stun or incapacitate the target; and said means to produce said effective amount of said electrical potential not including a moving striker element driven solely by inertia;

wherein upon impact with the target said piezoelectric element discharges the electrical potential through the first and second electrodes to the target.

57. The projectile of claim 56, further comprising:

said means to produce said electrical potential is operable to produce an electrical potential in said piezoelectric element of at least 25,000 volts.

58. The projectile of claim 57, further comprising:

said means to produce said effective amount of said electrical potential does not include a moving striker element.

59. The projectile of claim 56, further comprising:

said means to produce said effective amount of said electrical potential does not include a moving striker element.

* * * * *